United States Patent [19]

Paulsen

[11] Patent Number: 4,610,216

[45] Date of Patent: Sep. 9, 1986

[54] PAPER COLORING APPARATUS

[76] Inventor: Gustav Paulsen, Roaldsoy, N-4000 Stavanger, Norway

[21] Appl. No.: 719,207

[22] Filed: Apr. 2, 1985

[51] Int. Cl.[4] ..... B05C 1/28

[52] U.S. Cl. ..... 118/46; 118/249; 118/262

[58] Field of Search ..... 118/249, 262, 46

[56] References Cited

U.S. PATENT DOCUMENTS

| | | | |
|---|---|---|---|
| 3,116,166 | 12/1963 | Halley | 118/249 X |
| 4,029,833 | 6/1977 | Kosta | 118/249 X |
| 4,363,288 | 12/1982 | Fara | 118/262 X |
| 4,495,886 | 1/1985 | Phelps | 118/249 |

*Primary Examiner*—John P. McIntosh

*Attorney, Agent, or Firm*—Schwartz, Jeffery, Schwaab, Mack, Blumenthal & Evans

[57] ABSTRACT

A paper coloring apparatus particularly for rotation printing presses and, ordinarily for the coloring of white paper to the desired color before the paper web (2) is drawn into the printing press. The paper web (2) passes over several guide rollers (3, 4, 5) plus a displaceable roller (8) which can be displaced towards and away from a coloring roller (10). The coloring roller (10) is supplied with dye from a dye bath (12) via a dye roller (13) which communicates with dye bath (12), and a displaceable intermediate roller (14) which can be displaced towards and away from engagement with the dye roller (13) and coloring roller (10). The displaceable rollers (8, 14) are displaced with the aid of compressed air cylinders (11, 15), and the pressure of the displaceable rollers (8, 14) against the counter-rotating rollers (10, 13) is regulated with the aid of regulation valves in the appropriate compressed air circuits. The displaceable roller (14) has a moveable support such that it automatically adjusts to constant alignment in both horizontal and vertical planes with uniform pressure along the entire length of the displacement roller. The paper coloring apparatus according to the invention may be arranged alternatively to color the top and bottom sides of the paper web (2).

6 Claims, 4 Drawing Figures

PAPER COLORING APPARATUS

BACKGROUND OF THE INVENTION

1. Field of the Invention

This invention concerns a paper colouring apparatus, particularly for rotation press machinery. The apparatus for the colouring ordinarily of white paper to a desired colour before the paper web is drawn into the printing press.

2. Prior Related Art

In such apparatuses the paper web passes a number of rollers. Some of the rollers must be displaceable, so that the paper web can pass through the apparatus without coming in contact with dye bearing rollers, in the event the paper is not to be coloured before entering the press. The displaceable rollers must also be adjustable such that they touch the neighbouring rollers with a predetermined pressure when the apparatus is set for colouring. It is important that this pressure be uniform along the entire length of the roller.

With the known apparatuses of this type, the rollers are displaced and adjusted with the aid of mechanical devices such as screws, eccentrics and springs.

A drawback with such an apparatus is that it is very difficult and time-consuming to adjust the rollers; this causes increased paper wastage and, in part, lower quality colouring.

It is also a disadvantage of a known apparatuses of this type that they are only arranged to colour one side of the paper web. If, as an alternative, the other side of the paper web is to be coloured, a similar apparatus must be installed with a different roller adjustment in series with the first.

A further disadvantage of the known apparatuses is that the roller, due to incorrect adjustment, may easily cause the apparatus to exert greater resistance to the feed through of the paper web, so that the paper web length control of the press is disturbed. This disadvantage is particularly pronounced when printing data forms and which comprise a set of several copies.

SUMMARY OF THE INVENTION

A purpose of the present invention is to produce a paper colouring apparatus, particularly for rotation presses, where the above-mentioned disadvantages are eliminated.

In accordance with the above object there has been provided a paper colouring apparatus, particularly for rotation printing presses and, ordinarily, for the colouring of white paper to the desired colour before the paper web is drawn into the printing press. The paper web passes over several guide rollers plus a displaceable roller which can be displaced towards and away from a colouring roller. The colouring roller is supplied with dye from a dye bath via a dye roller which communicates with dye bath, and a displaceable intermediate roller which can be displaced towards and away from engagement with the dye roller and colouring roller. The displaceable rollers are displaced with the aid of compressed air cylinders, and the pressure of the displaceable rollers against the counter-rotating rollers is regulated with the aid of regulation valves in the appropriate compressed air circuits. The displaceable roller had a moveable support such that it automatically adjusts to constant alignment in both horizontal and vertical planes with uniform pressure along the entire length of the displaceable roller. The paper colouring apparatus according to the invention may be arranged alternatively to colour the top and bottom sides of the paper web.

BRIEF DESCRIPTION OF THE DRAWINGS

Further objects, features and advantages of the present invention will become apparent from the detailed description of preferred embodiments which follows, when considered together with the attached figures of the drawing, wherein.

DETAILED DESCRIPTION OF THE INVENTION

Figure 1:
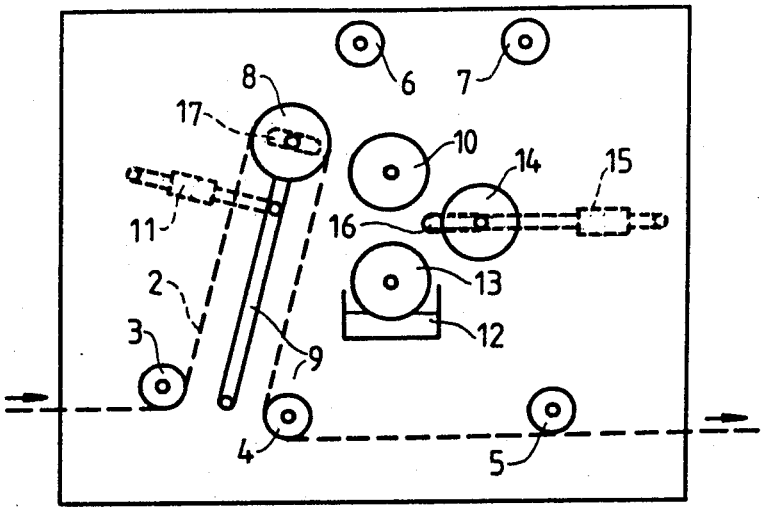
FIG. 1 shows a schematic representation of a paper colouring apparatus in accordance with the invention, seen from the side and adjusted for free feed through of the paper web without colouring of the paper web and with one side plate removed to provide a better view.
Figure 2:
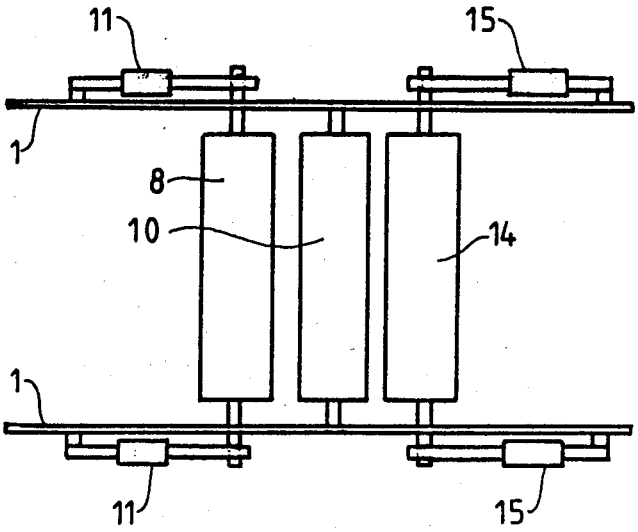
FIG. 2 shows the apparatus according to the invention from above, with the same adjustment as in FIG. 1, though with only three rollers drawn in to provide a better view.
Figure 3:
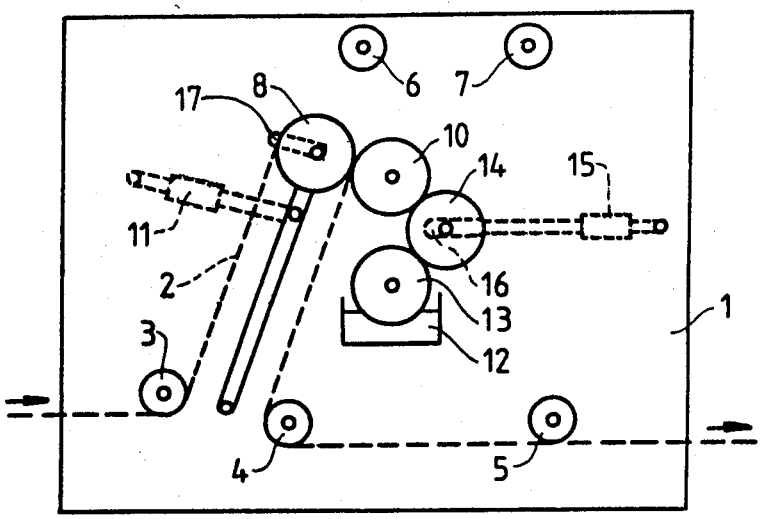
FIG. 3 shows the apparatus from the side, adjusted for colouring of the paper web's top side, and with one side plate removed to provide a better view.
Figure 4:
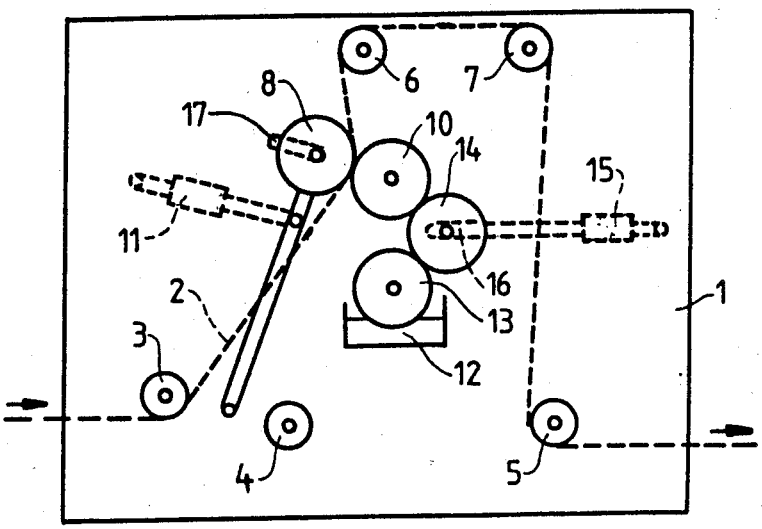
FIG. 4 shows the apparatus from the side, adjusted for colouring of the paper web's bottom side, and with one side plate removed to provide a better view.

In the drawings, the reference numeral 1 denotes the two side plates of the apparatus. The paper web 2, which is drawn with a broken line, enters the apparatus at the inlet end and passes several guide rollers 3, 4 and 5 (FIGS. 1 and 3), or 3, 6, 7 and 5 (FIG. 4), respectively which are permanently supported in side plate 1. Before exiting from the apparatus the paper is led onward to the printing press, not shown. The paper web 2 also passes a displaceable roller 8 supported between the upper ends of two arms 9, whose lower ends are each rotatably supported in one side plate. The roller 8 can be displaced towards and away from a colouring roller 10 permanently supported between the side plates 1. The roller 8 is displaced with the aid of two compressed air cylinders 11 which are installed between their respective arms 9 and proximate side plate 1, and which have a common air supply. The colouring roller 10 receives dye from a dye bath 12, and an intermediate roller 14 moveably supported between the side plates 1. This can be displaced towards and away from the dye roller 13 and colouring roller 10 with the aid of two compressed air cylinders 15 which are installed between their respective shaft journals 14 and proximate side plate 1, and which have a common air supply. The shaft journals of the intermediate roller 14 slide in generous grooves 16 in the side plates 1, so that intermediate roller 14 automatically self-adjusts to provide the correct alignment between the dye roller 13 and colouring roller 10, and in the vertical plane, to provide uniform pressure along the entire length of the respective roller when the intermediate roller presses against it.

The apparatus rollers are driven exclusively by paper web 2 which is drawn through the apparatus by the printing press downstream, not shown.

The pressure of the displaceable roller 8 and thus the paper web against the colouring roller 10 is regulated with the aid of a separate, not shown regulation valve in the compressed air circuit which controls compressed air cylinders 11. In the same way, the pressure of the displaceable roller 14 against the dye roller 13 and colouring roller 10 is regulated with the aid of a separate, not shown regulation valve in the compressed air circuit which controls the compressed air cylinders 15. There is thus no mechanical arrangement to set and adjust the roller positions or roller pressure, as this is done automatically by the rollers 8 and 14 being controlled pneumatically with the aid of the compressed air cylinder pairs 11 and 15.

When the displaceable roller 8 presses the paper web 2 against the colouring roller 10, the latter is caused to rotate, and, when the displaceable intermediate roller 14 is pressed against the colouring roller 10 and dye roller 13, the intermediate roller 14 and dye roller 13 are also set in rotation. The dye from the dye bath 12 is thus transferred via rollers 13, 14 and 10 to paper web 2. The pressure of the displaceable intermediate roller 14 against the dye roller 13 and colouring roller 10 regulates the amount of dye collected from the dye bath 12 and transferred to the paper web 2 via the rollers 14 and 10. The pressure of the displaceable roller 8 against the colouring roller 10 regulates the colouring pressure independently of the amount of dye.

Colouring roller 10 and intermediate roller 14 are made of rubber. All other rollers are made of metal.

As is apparent from the drawings, paper web 2 is led into one or the other side of the displaceable roller 8 according to which side of the paper web 2 is to be coloured. It is also apparent from the drawings that, when the top side of the paper web 2 is to be coloured, the paper is conducted over guide roller 4, but not guide rollers 6 or 7, and, when the bottom side of the paper web 2 is to be coloured, the paper web is conducted over guide rollers 6 and 7, but not guide roller 4.

Because the displaceable rollers 8 and 14 are automatically adjusted with the aid of compressed air, adjustment will be very good. This means that these rollers provide little resistance to the movement of the paper web through the paper colouring apparatus, and it is therefore easy to draw the paper web 2 through the apparatus. Thus, the paper web length control of the printing press is not disturbed, a fact which, as mentioned above, is of very great consequence.

I claim:

1. Paper colouring apparatus particularly for rotation printing presses for the colouring ordinarily of white paper to the desired colour before the paper web (2) is drawn into the printing press, and where the paper web (2) passes several guide rollers (3, 4, 5) plus a displaceable roller (8) which can be displaced towards and away from a colouring roller (10), in that the colouring roller (10) is supplied with dye from a dye bath (12) via a dye roller (13) which protrudes down into the dye bath (12), and a displaceable intermediate roller (14) which can be displaced towards and away from the dye roller (13) and colouring roller (10), characterized in the displaceable rollers (8, 14) being displaced with the aid of compressed air cylinders (11, 15), and by the pressure of the displaceable rollers (8, 14) against the counter-rotating rollers (10, 13) being regulated with the aid of regulation valves in the appropriate compressed air circuits, in that the displaceable roller (14) has a moveable support such that it automatically adjusts to constant alignment in both horizontal and vertical planes with uniform pressure along the entire length of the roller.

2. A paper colouring apparatus, particularly for rotation printing presses, comprising:

a plurality of guide rollers for guiding a paper web;
a displaceable first roller for guiding a paper web;
a dye bath;
a dye roller communicating with the dye bath;
a colouring roller for colouring the paper web;
a displaceable, intermediate second roller for engaging the dye roller for supplying the colouring roller with dye;
a first actuating means for displacing said displaceable first roller into engagement with the colouring roller; and
second actuating means for displacing said displaceable, intermediate second roller into engagement with the colouring roller and the dye roller.

3. An apparatus as recited in claim 2, further comprising first regulating means for regulating the pressure of said first roller against said colouring roller; and
second regulating means for regulating the pressure of said second roller against said colouring and dye rollers.

4. An apparatus as recited in claim 2, further comprising a movable support for the second roller, for automatically adjusting the second roller to be constantly both vertically and horizontally aligned, and for providing equal pressure along the entire length of the second roller.

5. An apparatus as recited in claim 2, wherein said first and second actuating means comprise compressed air cylinders, and wherein said first and second regulating means comprise valves for regulating the compressed air cylinders.

6. An apparatus as recited in claim 2, wherein said first and second actuating means displace said displaceable first roller and said displaceable, intermediate, second roller in a direction substantially perpendicular to their central axis.

* * * * *